US005471902A

United States Patent [19]

Chaplin

[11] Patent Number: 5,471,902

[45] Date of Patent: Dec. 5, 1995

[54] TUNING SYSTEM FOR PIANOS

[75] Inventor: Paul D. Chaplin, Newcastle, Australia

[73] Assignee: Athenry Enterprises Limited, Hong Kong, Hong Kong

[21] Appl. No.: 200,180

[22] Filed: Feb. 22, 1994

[51] Int. Cl.[6] ..... G10C 3/10; G10D 3/14

[52] U.S. Cl. ..... 84/202; 84/305

[58] Field of Search ..... 84/200, 201, 202, 84/203, 204, 205, 206, 207, 208, 297 R, 303, 304–305

[56] References Cited

U.S. PATENT DOCUMENTS 514,976 2/1894 Weber ..... 84/202
1,924,720 8/1933 Kringel ..... 84/202

FOREIGN PATENT DOCUMENTS

8777/07 of 1907 Australia .

OTHER PUBLICATIONS

David Wexler and Co. 1965–1966 Catalog p. 450.

*Primary Examiner*—Thomas M. Dougherty
*Assistant Examiner*—Cassandra C. Spyrou
*Attorney, Agent, or Firm*—Edwin D. Schindler

[57] ABSTRACT

A system for tuning a piano or a similar instrument comprises a metal assembly 44 or unit 50, preferably cast iron, composite, zinc or alloy material containing lubricating elements, and tuning pins 10. The pin 10 may have a recessed portion 14 surrounded by a sleeve 30 preferably of bronze or brass to assist and protect the pin when being tuned. The pin 10 has a radial head 12 which seats into a complementary radial bore 31 within aperture 26 allows the pin 10 to rotate about and swivel across its axis 24. The pin 10 and sleeve 30 are held in the assembly 44 or unit 50 under compression from lockscrew 34 bearing down upon the flat head 32 of the pin with the pin pivoting on curved end 38 of the lockscrew 34. The tuning end is free to move within the aperture clearance 33. The tuning system can be provided either as an individual self contained pin 10, sleeve 30 and lockscrew 34 in an assembly 44, or one or more blocks or sectioned units 50 of said pins, which are mounted to the piano frame preferably from the rear by means of one or more screw threaded lugs 27.

13 Claims, 2 Drawing Sheets

TUNING SYSTEM FOR PIANOS

The present invention relates to improvements in the construction of tuning systems for pianos and such like instruments.

BACKGROUND OF THE INVENTION

Conventional construction of tuning pins and similar instruments involves a threaded metal pin driven into a hardwood pinblock. The grip of the pin in the wooden block depends on the thread. The stress that has to be withstood by the wood often results in cracking, splitting or sagging of the pinblock. Moreover, wooden pinblocks are subject to changes in humidity and other climatic variables.

Once a pinblock cracks, sags, splits, shrinks or warps, the piano is in most cases too costly to repair or to salvage as the repair work is extremely labour-intensive. The most common major defect in old pianos is that they are unable to hold their tune as a result of the pinblock sagging, splitting or cracking.

In some instances, modern manufacturing techniques incorporate the use of laminated pinblocks and tuning pins of a larger diameter. This is done in an attempt to minimise effects of climatic changes and to improve tuning stability. However, these can act to make subsequent tuning more difficult.

Conventional wooden pinblocks are made from a selection of hardwoods which, from the point of view of conservation, is a diminishing resource.

In other constructions where a metal plate is used, the pins often break due to seizure in the plate especially if the time between tunings is long. The pins can also bend about the stress point when being tuned and set for example, of the Beale and Vader type as described in the Australian patent application 8777/07 filed the 22nd May 1907.

Therefore, in such constructions, the ability to be able to set the pin, when required, is impeded by its design.

Hence, an alternative construction is required.

SUMMARY OF THE INVENTION

According to a first aspect of the invention, there is provided a tuning system for a piano or similar instrument comprising a metal assembly or unit having at least one aperture for accommodating a tuning pin, each pin having a radial head with a top, a tuning end distal from said top for accommodating a tuning device, a hole through said tuning end for securing a tuning wire to said pin, said aperture having a pivot clearance between the tuning end of said pin and said metal assembly or unit and retaining means retaining said pin in said aperture and having an end upon which said top of said pin pivots, said tuning end extending from said aperture with said radial head retained in a complementary radial bore of said aperture.

According to a second aspect of the invention, there is provided a tuning pin for a piano or similar instrument comprising a tuning end for accommodating a tuning lever, a hole through said tuning end for securing a tuning wire to said pin, the pin having a radial head.

According to a further aspect of the invention, there is provided a tuning pin for a piano or similar instrument further comprising a recessed portion joined to said head and a sleeve within said recessed portion.

According to yet a further aspect of the invention, there is provided self-contained pin, sleeve and lockscrew assemblies, where said pins according to the second or further aspects of the invention are contained in a composite metal or alloy housing containing lubricating elements, either singly or in one or more blocks, or sectioned units of said tuning pins, which are then mounted flush to the metal frame of an instrument from the front or rear, either by a series of tapped metal screws, bolts, or otherwise affixed. The holes for said screws or bolts are drilled or cast into one or more overhanging lugs, by which the assemblies or units are attached to said metal frame.

Preferably the pin has a radial head with a radius of 8 millimetres with respect to the axis of said pin. The sleeve is preferably made of sintered bronze or brass, although may be made of nylon, or other suitable plastics material.

The term radial as used herein means a non-Euclidean surface defined by two orthogonal curvilinear coordinates.

BRIEF DESCRIPTION OF THE DRAWINGS

Preferred embodiments of the invention will now be described with respect to the figures in which.

PREFERRED MODES OF PERFORMING THE INVENTION

Figure 1:
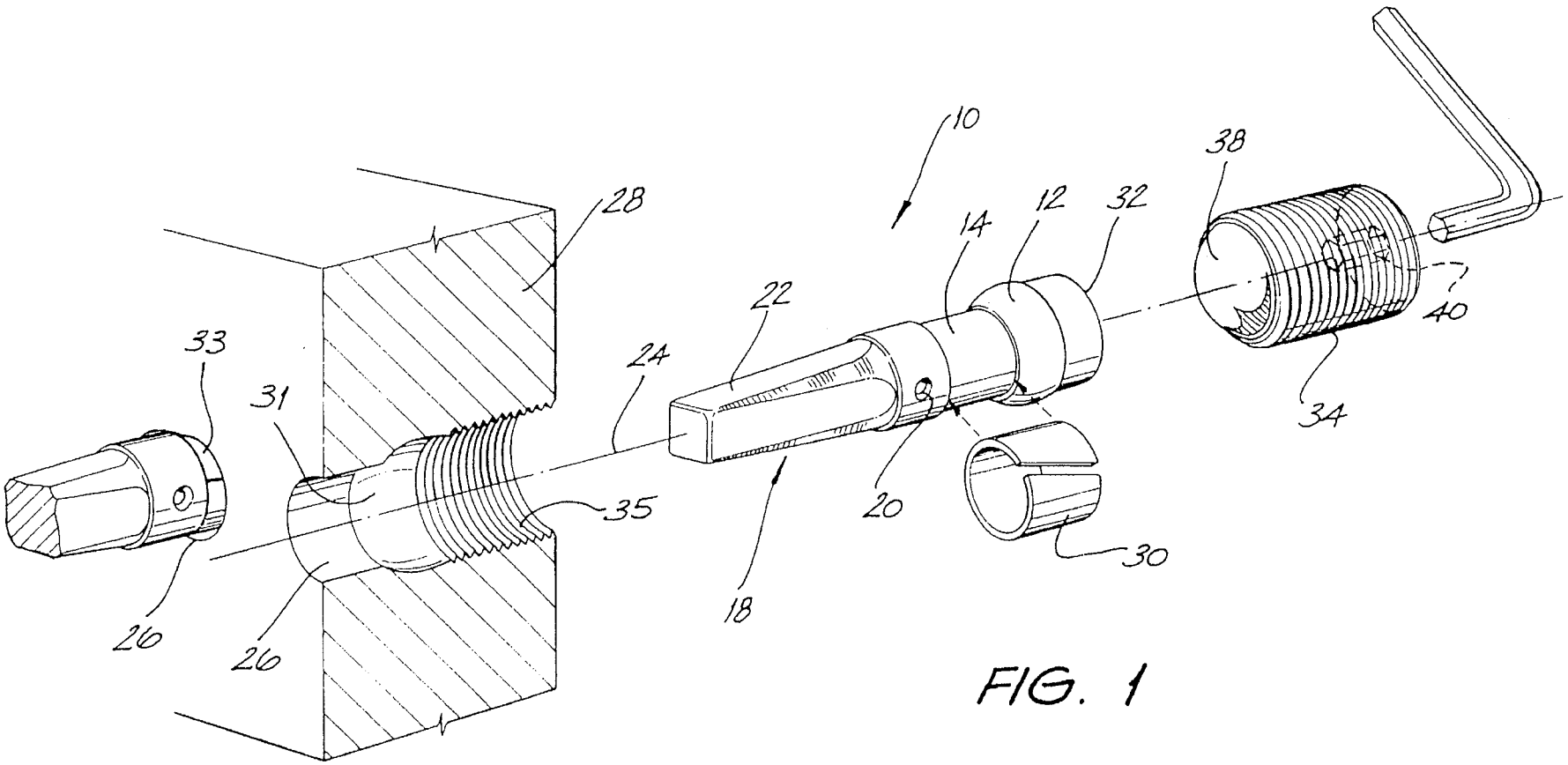
FIG. 1 shows an exploded perspective schematic of a first embodiment of a pin and unit construction according to the invention.

As shown in FIG. 1, the pin 10 has a radial head 12, a recessed portion 14 and a tuning (and piano wire retaining) end 18. A string hole aperture 20 extends through the end 18, as is well known in the art, for a piano wire to be inserted therethrough.

As in a conventional pin, the end 18 is shaped with four flat surfaces 22 to accommodate a tuning hammer or tuning lever. This lever or hammer (not shown) when used by the piano tuner tunes the respective wire to the required pitch by rotation of the pin about the axis 24.

Each pin 10 as shown in FIG. 1 is located in an aperture 26 of the assembly 44 or unit 50. A sleeve 30 encircles the recessed portion 14. This sleeve may be made of sintered bronze or brass and may be continuous or split. The pin 10 rests within the aperture 26 with the radial head 12 in contact with the complementary radial bore 31 of the aperture 26.

The pin 10 has a flat top 32 upon which lockscrew 34 seats. The lockscrew 34 is screwed into threaded bore 35 of the assembly 44 or unit 50. The lockscrew 34 has a curved shaped end 38 to provide single point surface contact between the top 32 of pin 10 and the lockscrew 34 thereby allowing the pin 10 to pivot on the curved shaped end 38 of the lockscrew 34. The lockscrew 34 has a shaped or socketed end 40 to allow an adjusting tool such as an Allen key to rotate the lockscrew 34 with respect to the bore 35. Screwing the lockscrew 34 into the bore 35 provides the required force on the pin 10 to retain it in the aperture 26.

The radial head 12 allows the pin 10 to both turn about the axis 24 and swivel across the axis 24 on the pivot point of the end 38 within the pivot clearance 33 of aperture 26, enabling the pin 10 to be tuned and set.

Figure 2:
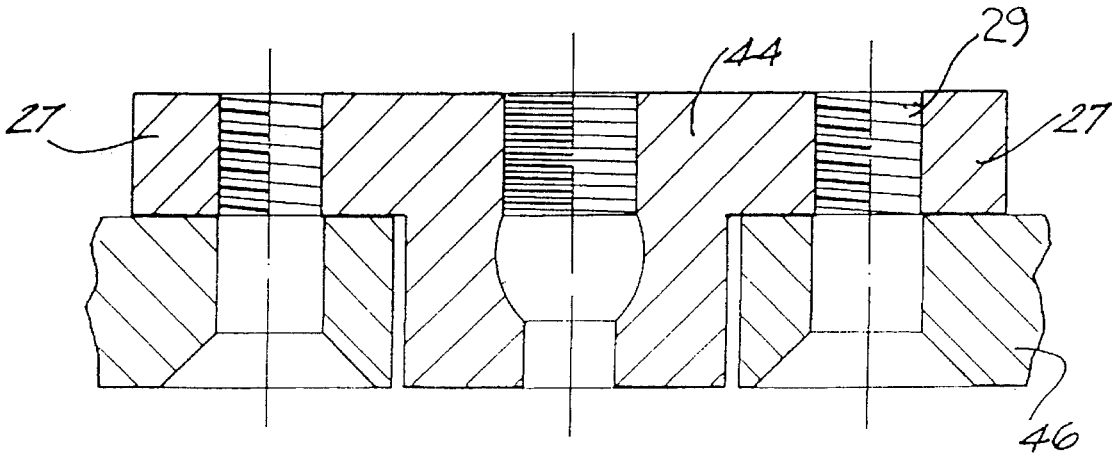
FIG. 2 shows a self contained individual assembly affixed to a metal frame.
Figure 3:
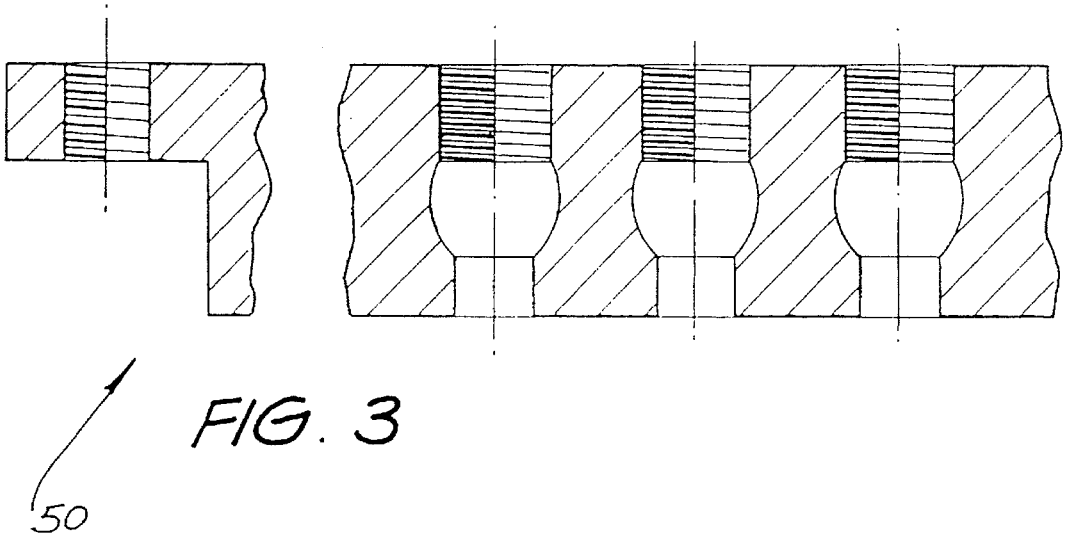
FIG. 3 shows a plurality of pin apertures in the form of a block or sectioned unit of tuning pin apertures to house the pins and lockscrews according to the invention.

As shown in FIGS. 1, 2 and 3, these pins may be used as either an individual self contained pin assembly 44 or pin assemblies, sectioned into one or more blocks or units 50 of pins (FIG. 3) for example to form bass, middle and treble sections. While FIG. 2 shows a single pin, such an assembly can comprise a number of pins and associated apertures, and could be used in the manufacture of new pianos, or to repair or replace a damaged section of a piano. These self contained assemblies 44, or units 50 are fitted by means of one or more fixtures, for example metal lugs 46 or similar into the piano frame 28.

While in the following the description will be with respect to a single pin, it is to be understood that the description is applicable to a plurality of pins. Since each individual make of a piano is unique in its scaling and design, the task of tuning often requires a different technical approach. The construction described herein provides an adaptable solution to such variations when present.

When tuning the piano, the pin 10 is rotated about the axis 24. The radial head 12 and the sleeve 30, enables the pin 10 to move freely providing smoothness and uniformity of feel, allowing the pin to be pulled straight onto the required pitch, consequently eliminating the need to set the pin in such instances.

The pin 10 is designed so as to substantially reduce the pressure around the stress point, when being borne down upon by the tuner. The radial head 12 eliminates pin flex or bend and allows the pin 10 to both turn about the axis 24 and swivel across the axis 24 about the pivot point 38 of the lockscrew 34 in the complementary radial bore 31, within the aperture pivot clearance 33. The preferred aperture pivot clearance between the pin 10 and the assembly 44 or unit 50 is between 0.01–0.05 mm.

Due to the consistency of feel it would be possible to "automatically" tune a wire. For example, using a torque sensing, motorised tool the pin can be first adjusted to the expected required torque setting. The tuning of the wire would then be determined by measurement either of the wire's resonance (applying a frequency swept signal and looking for the maximum response) or by vibration of the wire while sensing its frequency response. The tuning would then be repeated until the wire was set to the required note, by adjusting (increasing or decreasing) the torque applied by the tool. Such technology is not currently possible with existing systems due to the inconsistency of torque from one pin to the next. The sleeve 30, when provided, forms a buffer between the pin 10 and the assembly 44 or unit 50, regulates the pivot clearance 33 and protects the pin 10 from wear around this critical gap. The radial head 12 and sleeve 30 enable the pin 10, when required, to be evenly and effectively set to the correct pitch without causing undue stress upon the tuning pin, therefore eliminating the possibility of pin seizure and/or breakage. The radial arc of the pin 10 gives the pin a superiority of feel for tuning and setting purposes over a conventional tuning pin, maintaining a consistency of feel from one pin to the next, allowing the pin 10 and string to be effectively set, overcoming the tension placed upon the string by the pressure bar (not shown).

A lubricant may be used to reduce friction between the pin and radial bore 31 without slippage. Lithium based grease has been found suitable.

The tuning system, being sectioned into either a number of individual self contained pin assemblies 44, (FIG. 2) or one or more blocks or units of tuning pins 50, (FIG. 3) makes it possible for these assemblies 44 or units 50 to accommodate being more simply and effectively fitted to any piano plate, prior to stringing the instrument. Such assemblies interlock with the piano plate thereby forming a truss, reinforcing and strengthening the piano plate, by virtue of the dimensions of the tuning system being substantially thicker than any piano plate per se. Standard piano plates being too thin to house the tuning pin 10 and lockscrew 34.

This sectionalising of the tuning system results in the elimination of storage, handling, assembly and fitting costs and associated problems that occur at the factory level with existing conventional tuning systems.

The assemblies 44 or units 50 also are much more inexpensive to manufacture and much easier and simpler to install than existing technology. The assemblies 44 or units 50 are screwed or bolted to the plate by means of a series of tapped screw holes 29 within lugs 27 of the assemblies 44 or units 50, or otherwise affixed.

For strength, the pin 10 and lockscrew 34 are made of annealed alloy steel while the sleeve 30 is made of sintered bronze or brass. The pin or screw may be blued, nickel or chrome plated, or otherwise coated. The individual assembly 44, or sectioned block or unit 50 may be made of cast iron, alloy, zinc or composite materials containing disseminated graphite flakes or other similar lubricating elements. Such composite materials containing lubricating elements being necessary when used in conjunction with lithium based grease, or other external lubricant to facilitate free movement of the pin 10 across and about its axis 24 when being tuned and set. Standard cast iron piano plates do not contain such elements and so do not have these properties.

The amount of carbon including any disseminated graphite flakes within the chemical composition of the cast iron or alloy material is preferably 15–20 percent for an assembly 44 or unit 50. Cast iron may contain up to 4% carbon.

Figure 4:
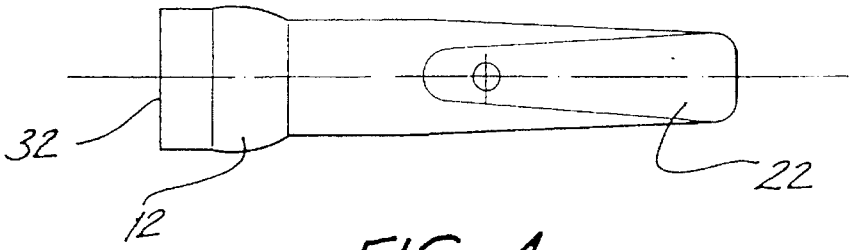
FIG. 4 shows an exploded perspective schematic of a second embodiment of a pin according to the invention.

Though the invention has been described above with respect to a preferred embodiment thereof, variations are possible within the knowledge of a person skilled in the art, for example, the sleeve 30 may be altered or extended to fit over the radial head, thereby further reducing wear on pin 10 and radial bore 31. Alternatively sleeve 30 and pin recess may be omitted altogether as shown in FIG. 4.

A ball bearing may be located between the curved shaped end 38 of the lockscrew 34 and the flat top 32 of the pin 10, a hollow cup being placed between both surfaces to accommodate the ball bearing, thereby reducing friction between the pin 10 and lockscrew 34.

Separate radial bore seat and radial bore seat housing may be used in place of the bore being integral with assembly 44 or unit 50. A radial head pin may be fitted into an assembly 44 or unit 50 with a frustoconical bore or a bore of greater radius.

The lockscrew diameter or thread pitch may be reversed, or the pin radius and/or length dimensions may be altered, to suit a given application while the aperture pivot clearance 33 may be altered to an oval or different shape.

The individual assemblies 44 or sectioned units 50 may be altered in size, shape, dimension, or design to fit into the piano frame, and may be instead of bolted or screwed into place, welded, sealed, latched, spring latched, screwed in as one piece, as a collet, mounted on rails, or somehow otherwise fitted and held into place in the frame 28, or existing pinblock or backing timber, either from the front or rear of the piano.

The lockscrew 34 may have instead of a curved shaped end 38, a domed, half spherical, pointed, conical or other shaped end suitable to bear upon the top 32 of a pin, with minimal friction, or may have a flat surface co-operating with a pin head of convex shape. Other plastics, metals, ceramics, composites or alloy materials and lubricating elements may be suitable for the assembly 44 or sectioned unit 50, sleeve 30, pin 10 or lockscrew 34, all of which have similar compression strengths and coefficients of friction to each other but whose compression strengths and coefficients of friction are higher than that for cast iron, alloy material, zinc, bronze or brass.

The pin 10, assembly 44, unit 50 and lockscrew 34 may be hardened, nitrided, or otherwise treated to enhance performance and inhibit wear.

The radial head eliminates pin flex or bend, and allows the pin to rotate about the axis and swivel across its axis in the complementary radial bore pivoting on the curved end of the lockscrew. The pin can thus be set to the correct pitch without putting stress on the pin.

The curved end of the lockscrew does four things:

1. Retains the pin in the aperture under compression at the desired setting, maintaining single point contact between the lockscrew and pin.
2. Holds the piano wire at the correct tension.
3. Allows the pin, when required, to be pulled straight to the correct pitch.
4. Allows the pin to pivot across its axis within the aperture without causing stress on the pin.

The radial bore allows the pin to swivel, rotate and be set in the assembly or unit without causing stress upon the pin and inhibits the possibility of the pin forming a seal in the assembly or unit or seizing in the future through corrosion or some other cause, rather than if the pin were placed in a bore with a positive locking conical taper (as described in the Beale prior art). The sleeve guards against pin wear and stress, assists the movement of the pin when being tuned and forms a buffer between the pin and the assembly or unit and thereby protects it when being borne down upon by the tuner.

The individual self contained pin assemblies allow the system to be simply and efficiently fitted to any existing piano plate with no retooling of the plate and only minimal cosmetic changes to the instrument.

The sectioned blocks or units of pins allows the unit to be manufactured separately from the main body of the instrument, whereby the system can be easily adapted to then be simply and efficiently attached to any piano plate.

The aperture pivot clearance enables the pin to rotate, swivel and pivot in the assembly or unit within predetermined parameters, for example between 0.01–0.05 mm, to allow the pin, when required, to be easily and effectively set.

What I claim is:

1. A tuning system for a piano or stringed instrument comprising at least one tuning pin, a metal assembly or unit having at least one aperture therein for accommodating said tuning pin, said tuning pin having a head with a top, a tuning end distal from said top for accommodating a tuning device, a hole through said tuning end for securing a tuning wire to said pin, and retaining means retaining said pin in said aperture and having an end upon which said top of said pin pivots, wherein said head is radial, being a surface defined by two orthogonal curvilinear coordinates, said tuning end extends from each said aperture with said radial head retained in a complementary radial bore of said aperture, and each said aperture including means for pivoting said radial head about and swiveling said radial head across its longitudinal axis, said means for pivoting including a clearance.

2. A tuning system for a piano or stringed instrument as claimed in claim 1, further including a recessed portion between said radial head and said tuning end, and a sleeve within said recessed portion.

3. A tuning system as claimed in claim 2 wherein said retaining means is a locking screw threaded into the aperture.

4. A tuning system as claimed in claim 3 wherein said top of said tuning pin includes a flat portion, wherein said screw has a curved end which bears upon said flat portion of said top of said tuning pin.

5. A tuning system as claimed in claim 4 wherein said tuning pin, and said locking screw are made of hardened tempered high tensile steel and said assembly or unit is made of cast iron, metal composite, zinc or alloy containing disseminated graphite flakes with the total carbon contained being in the proportion of 15–20 percent.

6. A tuning system as claimed in claim 5 wherein said sleeve is made of sintered bronze or brass.

7. A tuning system as claimed in claim 5 wherein said sleeve is made of nylon.

8. A tuning system as claimed in claim 6 wherein said pivot clearance is 0.01–0.05 mm.

9. A tuning system as claimed in claim 7 wherein said pivot clearance is 0.01–0.05 mm.

10. A tuning pin for a piano or stringed instrument comprising a tuning end for accommodating a tuning lever, a hole through said tuning end for securing a tuning wire to aid tuning pin, and a top end opposite to said tuning end and a radial head positioned along said pin distanced from said top end and said tuning end, said head being radial having a surface defined by two orthogonal curvilinear coordinates.

11. A tuning pin for a piano or stringed instrument as claimed in claim 10 further comprising a recessed portion joined to said head between said head and said tuning end; and a sleeve within said recessed portion.

12. A tuning pin as claimed in claim 11 wherein said sleeve is made of sintered bronze or brass.

13. A tuning pin as claimed in claim 11 wherein said sleeve is made of nylon.

* * * * *